US008272426B2

(12) United States Patent
Bausch et al.

(10) Patent No.: US 8,272,426 B2
(45) Date of Patent: Sep. 25, 2012

(54) METHOD OF AND APPARATUS FOR EQUALIZATION OF THE HEAT TRANSFER OF A CAST PRODUCT DURING THE SOLIDIFICATION THEREOF ON A METAL CONVEYOR BELT OF A HORIZONTAL STRIP CASTING INSTALLATION

(75) Inventors: Jörg Bausch, Düsseldorf (DE); Hans Jürgen Hecken, Schuld (DE)

(73) Assignee: SMS Siemag AG, Duesseldorf (DE)

( * ) Notice: Subject to any disclaimer, the term of this patent is extended or adjusted under 35 U.S.C. 154(b) by 0 days.

(21) Appl. No.: 12/452,953

(22) PCT Filed: Aug. 1, 2008

(86) PCT No.: PCT/EP2008/006362

§ 371 (c)(1),
(2), (4) Date: Jan. 27, 2010

(87) PCT Pub. No.: WO2009/018973

PCT Pub. Date: Feb. 12, 2009

(65) Prior Publication Data

US 2010/0132911 A1 Jun. 3, 2010

(30) Foreign Application Priority Data

Aug. 4, 2007 (DE) ..... 10 2007 036 969
Nov. 15, 2007 (DE) ..... 10 2007 054 554
Nov. 28, 2007 (DE) ..... 10 2007 057 278

(51) Int. Cl.
*B22D 11/06* (2006.01)

(52) U.S. Cl. ..... 164/429; 164/463; 164/479

(58) Field of Classification Search ..... 164/423, 164/424, 427, 429, 479, 463
See application file for complete search history.

(56) References Cited

U.S. PATENT DOCUMENTS

| | | | | | |
|---|---|---|---|---|---|
| 3,163,896 | A | * | 1/1965 | Rochester et al. | 164/481 |
| 4,506,725 | A | * | 3/1985 | Bedell | 164/463 |
| 4,573,521 | A | * | 3/1986 | Artz et al. | 164/451 |
| 4,721,152 | A | * | 1/1988 | Reichelt et al. | 164/429 |
| 4,817,702 | A | * | 4/1989 | Itoyama et al. | 164/432 |
| 4,976,024 | A | * | 12/1990 | Kimura | 29/527.6 |
| 5,301,741 | A | * | 4/1994 | Watson et al. | 164/461 |
| 5,392,843 | A | * | 2/1995 | Dolan | 164/485 |

FOREIGN PATENT DOCUMENTS

| | | |
|---|---|---|
| CA | 2 588 902 | 6/2006 |
| JP | 54-139835 | 10/1979 |
| JP | 60-250857 | 12/1985 |
| JP | 05-277668 | 10/1993 |
| JP | 06007900 | 1/1994 |

* cited by examiner

*Primary Examiner* — Kevin P Kerns
(74) *Attorney, Agent, or Firm* — Abelman, Frayne & Schwab

(57) ABSTRACT

An apparatus for casting near-net-shape, rectangular metal strands includes a horizontally circulating metal conveyor belt (7) with a cooled bottom a melt feeder (3') for casting the metal onto the conveyor belt(7), and an arrangement for feeding the solidified pre-strip under mechanical tension to a driver (16). A cooled pressure device (11, 12, 13) is arranged above the cast product (4) in a region of the deflection roller (8) of the metal conveyor belt (7) which is located downstream in a casting direction, for applying an adjustable pressure from above to the cast product (4) solidifying into the pre-strip (5); and immediately behind the metal conveyor belt (7) a cooling device (17, 19, 19')for cooling the bottom of the pre-strip (5) over its entire width.

6 Claims, 5 Drawing Sheets

PRIOR ART

PRIOR ART

METHOD OF AND APPARATUS FOR EQUALIZATION OF THE HEAT TRANSFER OF A CAST PRODUCT DURING THE SOLIDIFICATION THEREOF ON A METAL CONVEYOR BELT OF A HORIZONTAL STRIP CASTING INSTALLATION

BACKGROUND OF THE INVENTION

1. Field of the Invention

The invention relates to a method of and an apparatus for casting near-net-shape, rectangular strands from metal and a subsequent processing thereof into metal strips according to a DSC-method (direct strip casting) in a horizontal strip casting installation, wherein the metal melt is cast with a melt feeder on a horizontally circulating metal conveyor belt with a cooled bottom, and a liquid cast product is solidified to a pre-strip on the metal conveyor belt during displacement thereof and which after leaving the metal conveyor belt is fed, mechanically tensioned, to a driver by, e.g., smooth/pinch rollers. An installation with smooth/pinch rollers is not absolutely necessary, the installation can be realized without these rollers.

2. Description of the Prior Art

Because of uneven heat dissipation during solidification process of a strip, cast according to DSC-method under inert gas atmosphere without use of a casting compound, due to the upper surface of the strip being cooled only by convection with the ambient atmosphere and by heat radiation, while the bottom is in a direct contact with a cooled metal conveyor belt, the strip deforms already during solidification, firstly, upward and then downward.

At the start of cooling, the bottom of the material layer of the strip contracts mostly due to a very large temperature gradient. The entire strip bends upwardly in the middle, which results in very high stresses in the upper layer. Because these stresses are greater than the flow stress, they are reduced during the course of solidification again by subsequent elongation (flow), whereby opposite bending of the strip middle downwardly takes place. As a result, the low layer remains elongated, and the upper one shortened.

When the strip, which is usually not guided on its upper surface, leaves the metal conveyor belt with which it is displaced, the temperature of the strip over the strip thickness equalizes due to the reduced cooling of the strip bottom, the thermal tension also equalizes. The upper shortened and the lower elongated strip regions are subjected only to the backward bending, whereby the strip arches upwardly. The produced, as a result, stresses are below or close to the yield point, so that no or a very small backward formation of the arch resulting from the flow process, can be observed. The curve upward remains and results in arching of the strip narrow sides and also in a strip head like a ski.

During a further displacement, the degree of freedom of these arches in a longitudinal direction is reduced due to the gravity force of the strip horizontally displaceable on the adjoined roller table and/or by one or more pinch or smooth rollers which follow the metal conveyor belt, and firstly the strip tip and then the entire strip is mechanically tensioned and is forced to plane-parallel displacement downwardly.

This reduction of the degree of freedom leads to a need to reduce the stresses in the strip in the non-tensioned region, and that is why the strip narrow sides arch upwardly immediately after the strip leaves the metal conveyor belt. This behavior extends backwardly up to the region of the metal conveyor belt, so that the solidified strip has no contact anymore with the metal conveyor belt, and, thus, with the cooling medium and, as a result, has a non-homogenous temperature distribution over width of the strip that has a gutter profile.

In order to deal with this problem and to prevent the backward displacement of the pre-strip profile in the casting region and to insure passing into the upstream located machine, WO 2006/066552A1 suggests to arrange a guide element at the end of a primary cooling zone and in front of a conventional secondary cooling zone. As a rule, the guide element consists of several rollers arranged above and below the pre-strip in top-to-top or in offset-to-each other condition.

With a particular arrangement of rollers, the pre-strip is displaced in a plane located above a casting line in order to absorb the elongation of the bottom of the pre-strip by the carried-out upward movement. A roller arrangement, with which the pre-strip passes through the rollers as a wave, is also possible, however, it has not been used up to now.

The drawback of the method disclosed in WO 2006/066552 A1 consists in that the guide element that follows the metal conveyor belt can only partially influence the thermal processes on the metal conveyor belt.

SUMMARY OF THE INVENTION

Proceeding from this known state-of-the art, it is an object of the invention to provide a method and an apparatus with which in a simple manner, a maximum contact of the cast product with the metal conveyor belt and, thereby, optimization and equalization of heat transfer from the cast product to the metal conveyor belt over the entire casting width can be insured.

According to the method, the stated object is achieved in that in order to prevent a possible backward arching of strip edges that can begin in an outlet region of the caster and in order to average heat transmission to the casting product during solidification thereof on the metal conveyor belt, the following method steps are combined with each other:

establishing a maximum contact of the cast product with the metal conveyor belt, and to this end, a pressure device, which is arranged in a region of an end of the metal conveyor belt located downstream in a casting direction, applies pressure to the cast product solidifying into the pre-strip, preferably, to the strip edges thereof from above, and compensating a suddenly reduced cooling of a bottom of the pre-strip upon the pre-strip leaving the conveyor belt, and to this end, in a predetermined region, immediately behind the metal conveyor belt, the bottom and selectively and simultaneously, an upper surface of the pre-strip selectively over an entire width is additionally cooled.

As a result of application of pressure, according to the invention, to the cast product from above in the region of the end of the metal conveyor belt and in particular, to its edges, which induces a complete contact of the cast product bottom with the metal conveyor belt, in association with additional cooling of the pre-strip bottom, optimization and equalization of heat transfer from the cast product to the metal conveyor belt over the entire casting width and heat equalization within the pre-strip after it leaves the metal conveyor belt, can be achieved.

The necessary pressure is produced by a pressure roller acting on the entire width of the cast product or by partial pressure-applying rollers acting only on the strip edges. The pressure rollers are preferably separately driven and inwardly cooled. According to the invention, the necessary pressure can be applied with an abutting circulating pressure strip which likewise can be separately driven and cooled.

In combination with application of pressure to the cast product, according to the invention, simultaneously, cooling of the pre-strip bottom in a predetermined region immediately behind the metal conveyor belt is carried out, wherein the predetermined region can extend over the entire width of the pre-strip and, upon availability of smooth/pinch rollers, up to those. The cooling is effected by an open spray cooling, e.g., with water, and/or by closed cooling with a circulating cooling belt that, like the metal conveyor belt, is in contact with the bottom of the pre-strip. According to the invention it is possible, simultaneously, to provide a circulating cooling belt on the upper side of the pre-strip for guiding the pre-strip and for cooling the same in a predetermined adapted different manner.

Further particularities and advantages of the invention will be explained based on an exemplary embodiment shown in schematic drawings.

DETAILED DESCRIPTION OF THE PREFERRED EMBODIMENTS

Figure 1:
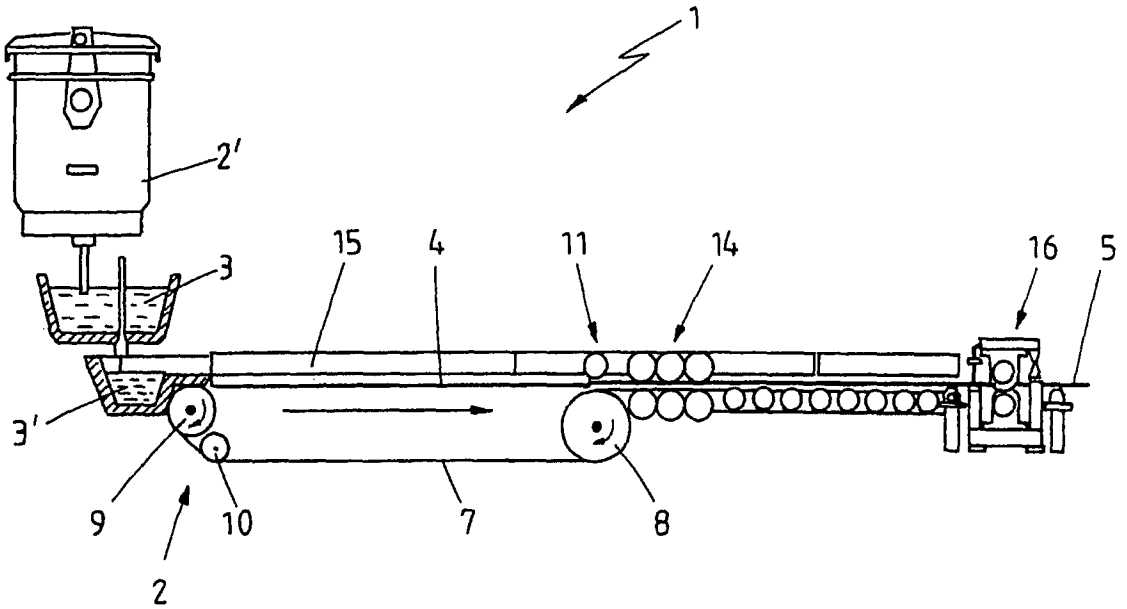
FIG. 1 a layout of a casting installation with its essential components.

FIG. 1 shows a side view of a casting installation in accordance with DSC-process with its essential components. In the casting direction (in the drawing from left to right), the installation consists of a separate caster 2 with a casting ladle 2', a distribution spout 3, a melt feeder 3', and a metal conveyor belt 7. The metal melt that flows from the casting ladle 2' through the distribution spout 3 downwardly, is delivered on the cooled metal conveyor belt 7 from the melt feeder 3' with a predetermined thickness as a cast product 4. The length of the metal conveyor belt 7 is so selected that the stay time of the cast product 4 on the metal conveyor belt 7 up to its most possible solidification to a pre-strip 5 is sufficient. The metal conveyor belt 7 that has, e.g., a thickness of only 1 mm, is driven and displaced by two deflection rollers 8, 9 and, e.g., a tension roller 10. For sidewise limiting of the cast product 4 on the metal conveyor belt, there is provided on each side of the metal conveyor belt 7, a displaceable therewith, dam block chain 15. Smooth/pinch rollers 14 adjoin the metal conveyor belt 7 for transporting and reliably guiding the completely solidified pre-strip 5, and mechanically grip the pre-strip and deliver it to a driver 16 that displaces it for further processing.

In this state-of-the art, corresponding strip casting installation 1, there are provided, according to the invention, in a region of the deflection roller 8, which are located at the end of the metal conveyor belt 7, above the cast product 4, a pressure roller 11. The pressure roller 11, which engages on the cast product 4, can insure, upon application of corresponding pressure, a maximal contact at least of the strip edges of the cast product 4 with the metal conveyor belt 7.

Figure 2A:
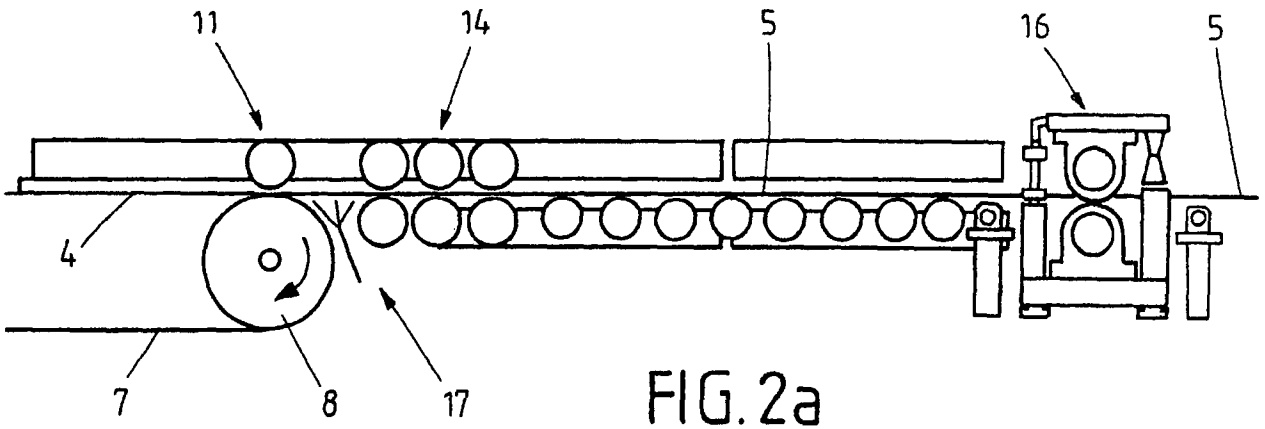
FIG. 2*a* a section of FIG. 1 at an increased scale with an open spray cooling.

In a section of FIG. 1, which is shown at an increased scale in FIG. 2*a*, in addition to a pressure roller 11, which applies a predetermined pressure from above to the cast product 4, there is provided, according to the invention, additional cooling of the bottom of the pre-strip 5 in form of spray cooling 17. This cooling is so designed that it acts only in a predetermined region that can extend over the entire width of the pre-strip 5 and, in the embodiment shown, from the end of the metal conveyor belt 7 up to the first of the lower smooth/pinch rollers 14.

Figure 2B:
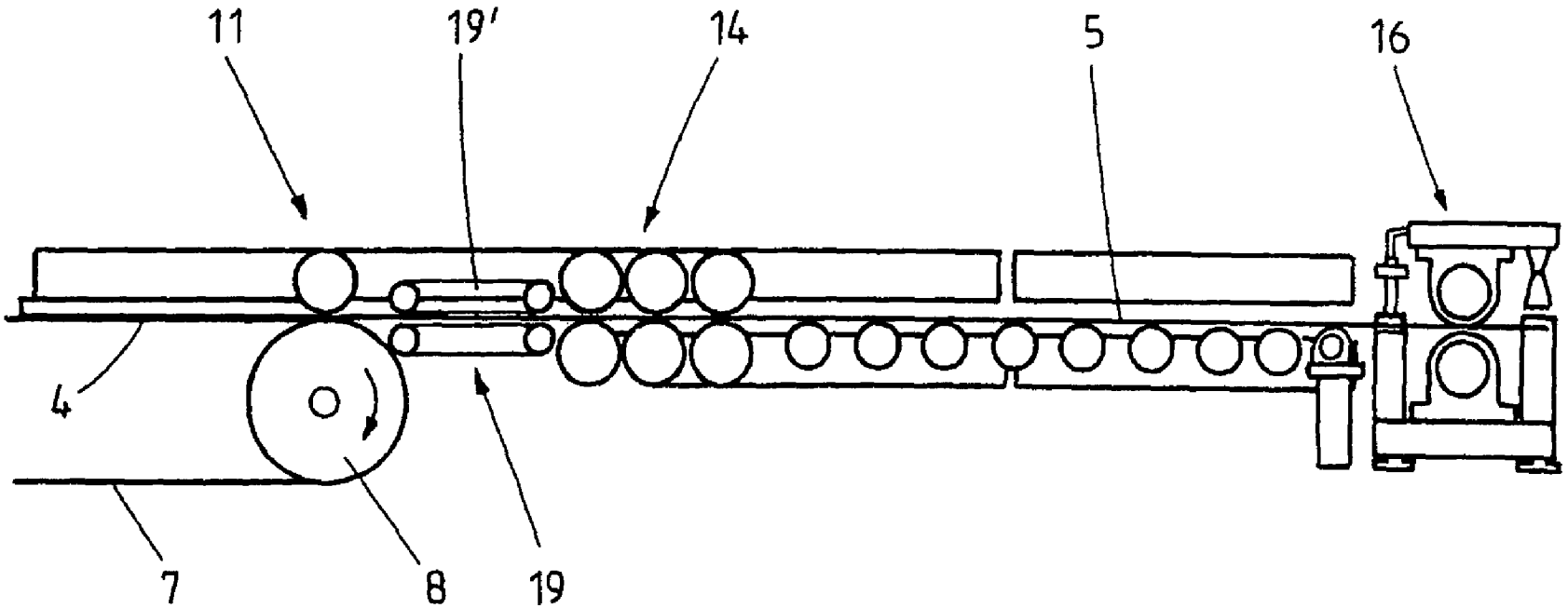
FIG. 2*b* a section of FIG. 1 at an increased scale with a rotary cooling conveyor.

An alternative cooling of the pre-strip 5 in form of a closed cooling is shown in FIG. 2*b*. This cooling that likewise takes places in a predetermined region immediately behind the deflection roller 8, is carried out using a cooling conveyor 19, 19'. Here, as with the spray cooling 17 shown in FIG. 2, only the bottom of the pre-strip 5 is cooled by the cooling conveyor belt 19 provided thereat and/or, if desired, also the upper surface of the pre-strip 5 is cooled by a further cooling conveyor belt 19' provided thereon.

To better explain the inventive pressure application to the cast product 4, the strip casting installation shown in FIGS. 1-2, is shown in FIGS. 3-6 in perspective view.

Figure 3B:
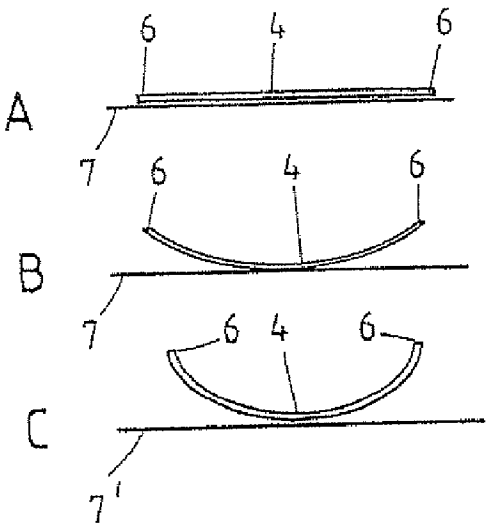
FIG.3b PRIOR ART
FIG. 3*b* cross-sections of a cast product according to the state-of-the art.
Figure 3A:
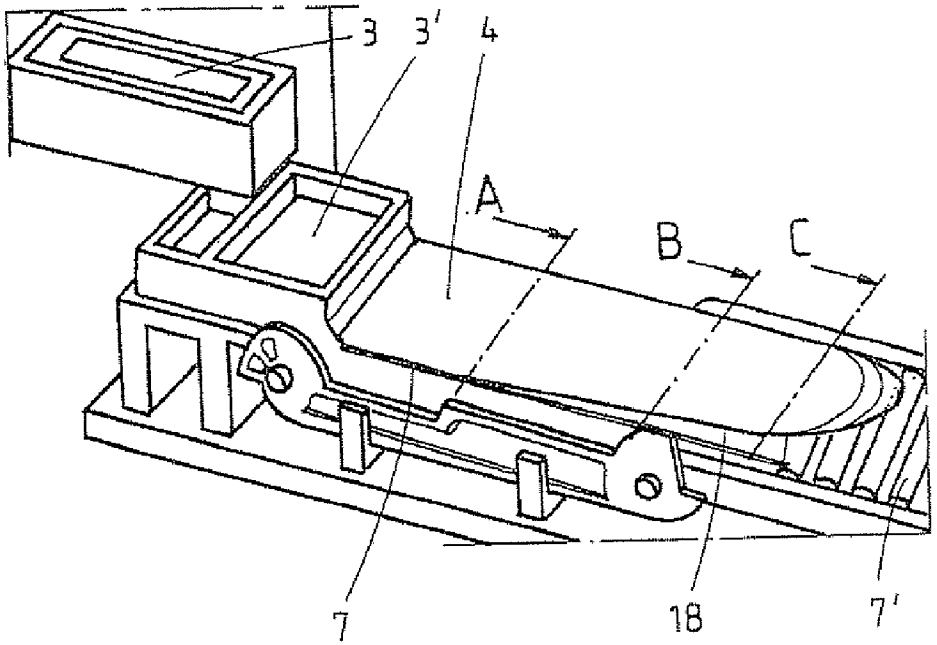
FIG. 3*a* a plan view of a section of FIG. 1 according to the state-of-the art.

FIG. 3*a* shows, e.g., a section of the strip casting installation, starting from the distribution spout 3/melt feeder 3' to the end of the metal conveyor belt 7 according to the state-of-the art. In FIG. 3*a*, different cross-sections A, B, C are marked on the metal conveyor belt 7 on which the strip beginning of the cast product 4 is located. The line A shows a cross-section of the cast product 4 in the first half of metal conveyor belt 7, line B shows a cross-section of the cast product 4 at the end of the metal conveyor belt 7, and line C shows a cross-section of the solidified pre-strip 5 that after leaving the metal conveyor belt 7, lies on a roller table 7'. In the strip casting installation according to the state-of-the art, the cast product 4 leaves its support, the metal conveyor belt 7, and arches with its strip edges 6 continuously upward. This arching begins in form of a wedge-shaped upwardly arched region 18 that starts somewhere in the region of the cross-section "A" and constantly increases, so that after leaving the metal conveyor belt 7 (in the region of the cross-section "C"), it has its shown end condition.

In FIG. 3*b*, the described arching of the strip is represented by cross-sections of the strip obtained at respective cross-sectional lines. At the cross-sectional line "A," the not yet completely solidified cast product 4 completely contacts its support, the metal conveyor belt 7, due to its gravity force and its available plastic characteristics. At the cross-sectional line "B," the strip edges 6 of the not any more plastic, cast product 4 disengage from the metal conveyor belt 7, and the cast product 4 now assumes a slightly arc-shaped cross-section. At the cross-sectional line "C," the arching of the strip edges 6 advanced further, and the cross-section of the, now completely solidified, pre-strip 5 that lies on the roller table 7', which prolongs the metal conveyor belt 7, has a shape somewhat resembling a gutter.

Figure 4B:
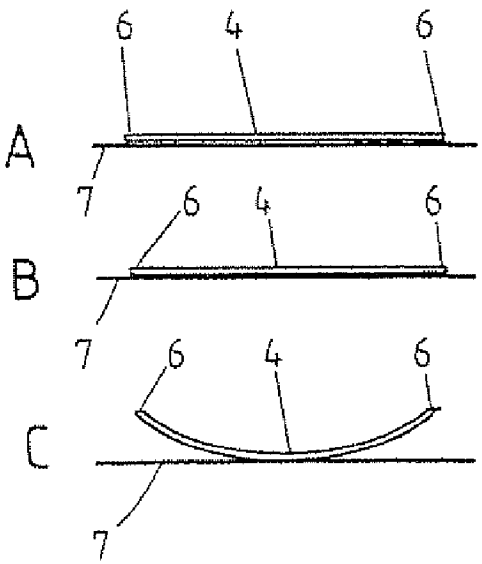
FIG.4b PRIOR ART
FIG. 4*b* a cross-section of a cast product/pre-strip with a pressure roller.
Figure 4A:
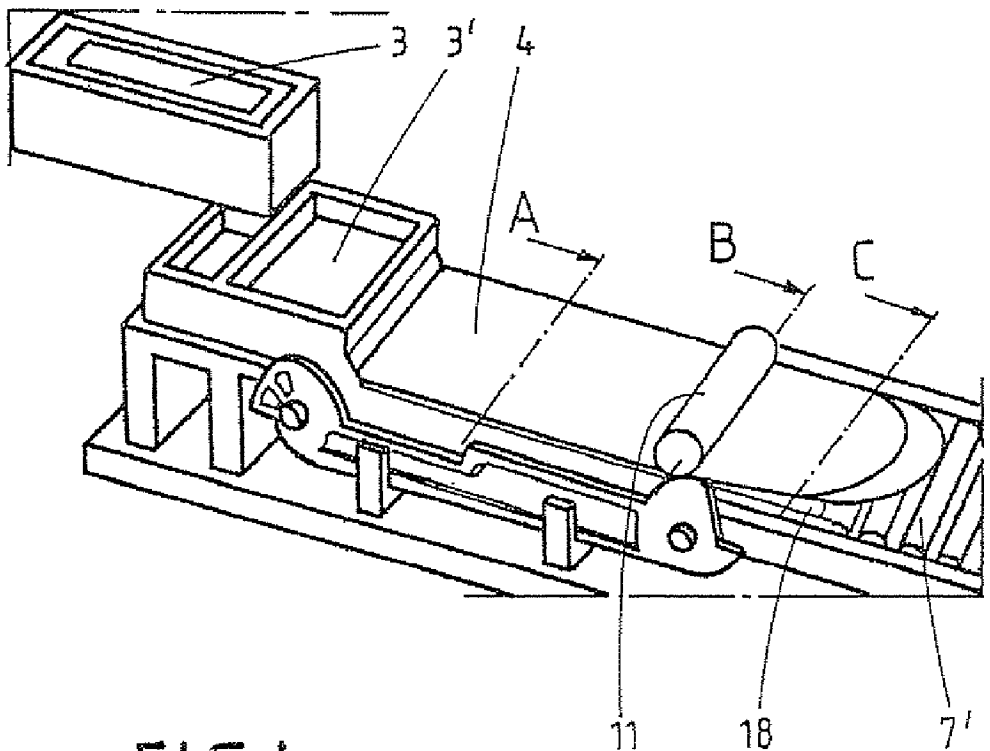
FIG. 4*a* plan view of FIG. 3 with a pressure roller.

FIG. 4*a* shows a change in the arching of the strip edges 6 due to the use of a pressure roller 11 in the region of the cross-section "B." the upwardly arching region 18 of the strip edges 6 begins only at the cross-section "B" with a noticeably smaller amount. The pressure roller 11 acts so that it suppresses the arching of the strip edges 6, reversing it, until they occupy a position corresponding to that in the region of the cross-section "A." A further, forwardly directed, arching of the strip edges 6 up to the cross-section "C" cannot be completely suppressed by the pressure roller 11, however, it is noticeably smaller than in FIG. 3*a*, without the pressure roller 11. The object of the invention of insuring a complete contact of the cast product 4 with its support, the metal conveyor belt 7, is completely achieved by the use of the pressure roller 11.

FIG. 4*b* shows strip cross-sections corresponding to the respective cross-sectional lines obtained with the use of the pressure roller 11. As without the pressure roller 11, at the cross-section "A," the cast product 4 flatly abuts the metal conveyor belt 7, but it also flatly abuts the metal conveyor belt 7 at its end at the cross-sectional line "B." Only after leaving the metal conveyor belt, there is observed a small strip edge arching that can be compensated by additional, according to the invention, cooling of the pre-strip bottom.

Figure 5:
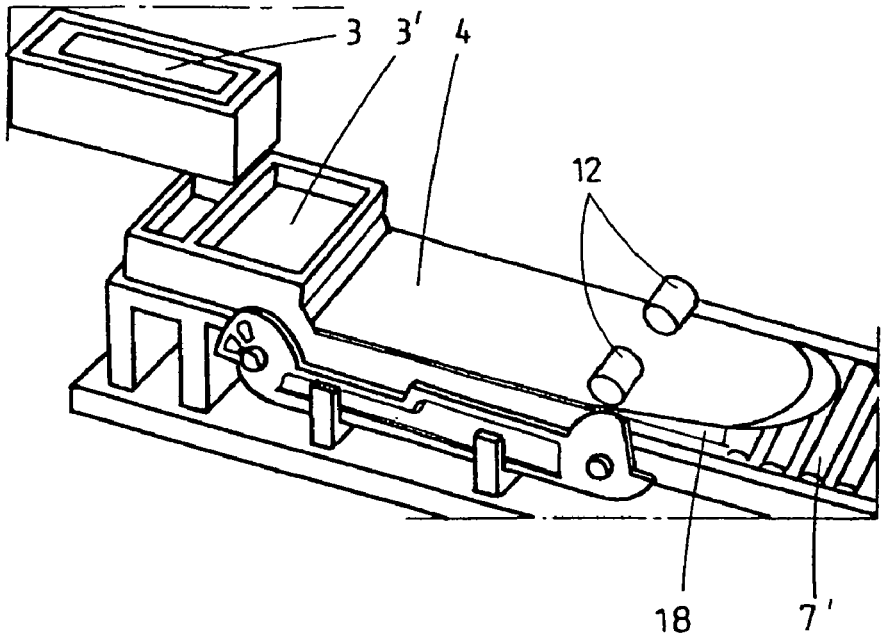
FIG. 5 a plan view of FIG. 3 with a partial pressure-applying roller.

In FIG. 5, as an alternative to the pressure roller 11, in the same region, at the end of the metal conveyor belt 7, there is provided a pressure device with two rollers 12 that apply each a partial pressure and act exclusively on the strip edge 6. The effect, which is achieved is noticeable from the arched region 18 and is totally comparable with the action of the pressure roller 11.

Figure 6:
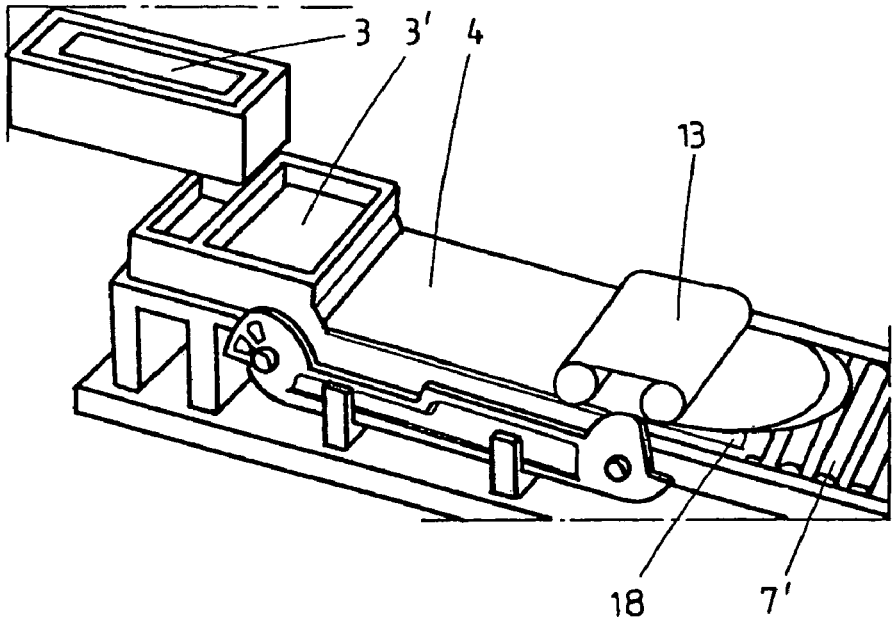
FIG. 6 plan view of FIG. 3 with a pressure band.

A further alternative to the use of the pressure roller 11 and the partial pressure-applying rollers 12 consists in use of a pressure belt 13 that applies pressure as shown in FIG. 6, to a large region of the cast product 4. Therefore, the shown here arched region 18 is somewhat smaller than with the use of previously shown rollers 11 and 12.

The invention is not limited to the shown embodiments but can be carried out, with regard to the used pressure devices and devices for additional cooling, with devices that differ from the described above if the inventive method is possible with these devices.

| REFERENCE NUMERALS | |
|---|---|
| 1 | Strip casting installation |
| 2 | Caster |
| 2' | Casting ladle |
| 3 | Distribution spout |
| 3' | Melt feeder |
| 4 | Cast product |
| 5 | Pre-strip |
| 6 | Strip edges of the pre-strip |
| 7 | Metal conveyor belt |
| 8, 9 | Deflection rollers |
| 10 | Tensioning roller |
| 11 | Pressure roller |
| 12 | Partial pressure-applying roller |
| 13 | Pressure belt |
| 14 | Smooth/pinch rollers |
| 15 | Dam block chain |
| 16 | Driver |
| 17 | Open cooling device (spray-cooling) |
| 18 | Arching region |
| 19 | Closed cooling (low circulating belt) |
| 19' | Closed cooling (upper circulating belt) |

-continued

| REFERENCE NUMERALS | |
|---|---|
| A | Cross-section of the casting product in the front half of the metal conveyor belt |
| B | Cross-section of the pre-strip at the end of the metal conveyor belt |
| C | Cross-section of the pre-strip after it leaves the metal conveyor belt |

The invention claimed is:

1. An apparatus for casting near-net-shape, rectangular strands from metal and a subsequent processing thereof into metal strips according to a DSC-method (direct strip casting) in a horizontal strip casting installation (1), comprising:

a horizontally circulating metal conveyor belt (7) having a cooled bottom and a deflection roller (8) and on which a liquid cast product (4) solidifies to a pre-strip during displacement thereof therealong;

a melt feeder (3') for casting the metal melt onto the conveyor belt (7);

roller means for feeding the solidified pre-strip under mechanical tension (14) to a driver (16) after the solidified pre-strip leaves the conveyor belt (7);

a pressure device (11, 12, 13) arranged above the cast product (4) in a region of the deflection roller (8) of the metal conveyor belt (7) which is located downstream in a casting direction, for applying an adjustable pressure from above to the cast product (4) solidifying into the pre-strip (5); and a cooling device (17, 19, 19') arranged immediately behind a downstream, in a casting direction of the strand, end of the metal conveyor belt (7) in a region between the downstream end of the conveyor belt and a first roller of the feeding roller means (14) for cooling a bottom of the pre-strip (5) over an entire width thereof as the pre-strip leaves the conveyor belt (7).

2. An apparatus according to claim 1, wherein the cooled pressure device is a driven pressure roller (11) acting on the entire width of the cast product (4).

3. An apparatus according to claim 1, wherein the cooled pressure device is a partial pressure-applying roller (12) acting on a respective edge (6) of the cast product (4).

4. An apparatus according to claim 1, wherein the cooled pressure device is a circulating pressure belt (13) acting on the entire width of the cast product (4).

5. An apparatus according to claim 1, wherein a cooling effect of the cooling device (17) extends over a region behind the metal conveyor belt (7) and, upon availability of the smooth/pinch rollers (14) up to the same.

6. An apparatus according to claim 5, wherein the cooling device is formed as at least one of open spray cooling means (17) and closed cooling means having a cooling belt (19, 19) circulating beneath the pre-strip (5) leaving the conveyor belt (7).

* * * * *